US006768467B2

(12) United States Patent
Jordan

(10) Patent No.: US 6,768,467 B2
(45) Date of Patent: Jul. 27, 2004

(54) METHOD OF RF GROUNDING GLASS MOUNTED ANTENNAS TO AUTOMOTIVE METAL FRAMES

(75) Inventor: David Frederick Jordan, Danville, NH (US)

(73) Assignee: Mia-Com Inc., Lowell, MA (US)

( * ) Notice: Subject to any disclaimer, the term of this patent is extended or adjusted under 35 U.S.C. 154(b) by 0 days.

(21) Appl. No.: 10/090,391

(22) Filed: Mar. 4, 2002

(65) Prior Publication Data

US 2003/0164801 A1 Sep. 4, 2003

(51) Int. Cl.[7] ..... H01Q 1/32
(52) U.S. Cl. ..... 343/713; 343/711
(58) Field of Search ..... 343/711, 713, 343/860, 861, 700 MS

(56) References Cited

U.S. PATENT DOCUMENTS

| | | | | |
|---|---|---|---|---|
| 5,521,606 A | | 5/1996 | Iijima et al. | 343/713 |
| 5,959,581 A | | 9/1999 | Fusinski | 343/700 MS |
| 5,999,134 A | * | 12/1999 | Dishart et al. | 343/713 |
| 6,198,447 B1 | | 3/2001 | Sauer | 343/713 |
| 6,204,480 B1 | | 3/2001 | Woodard et al. | 219/203 |

FOREIGN PATENT DOCUMENTS

| | | | |
|---|---|---|---|
| EP | 0 355 424 A2 | 2/1990 | H01Q/1/12 |
| EP | 0 794 589 A2 | 9/1997 | H01Q/1/12 |
| EP | 0 899 810 A2 | 3/1999 | H01Q/1/12 |
| JP | 10 126132 | 5/1998 | H01Q/1/32 |

OTHER PUBLICATIONS

Patent Abstracts of Japan, Publication No. 10126132, Publication Date, May 15, 1998, Application Date Oct. 18, 1996, Application No., 08276195.

Essex ARG Urethane Adhesives Webpage http://www.essexarg.com/U400HV.jsp (Feb. 27, 2002).

* cited by examiner

*Primary Examiner*—James Clinger

(57) ABSTRACT

A method for RF grounding glass mounted antennas to metal automotive frames comprising the steps of (1) providing an RF grounding path on said glass from the antenna mounting location to an edge of said glass located proximate to said metal frame, wherein said path is provided prior to installation of said glass into said metal automotive frame; (2) providing a first RF grounding contact from said antenna to said RF path; and (3) providing a second RF grounding contact of said RF path to said metal frame upon installation of said glass in said metal frame.

17 Claims, 2 Drawing Sheets

METHOD OF RF GROUNDING GLASS MOUNTED ANTENNAS TO AUTOMOTIVE METAL FRAMES

FIELD OF THE INVENTION

The present invention relates to the mounting of antennas, and more specifically to the mounting of an automotive antenna to provide an RF contact to the vehicle roof.

BACKGROUND OF THE INVENTION

Antennas have been used on automobiles for many years. Originally, antennas were installed on automobiles to allow for reception of signals for the car radio. A whip antenna protruding from one of the vehicle fenders for radio reception was standard on most automobiles. Later, antennas that were either embedded within or affixed to the inside of the windshield of the automobile were developed. These in-glass or on-glass antennas ran around the perimeter of the windshield and were less visible than the whip antennas and less susceptible to damage from external elements such as weather or vandalism.

Today, complicated on-board communication systems are used in the automotive industry. Vehicle manufacturers offer systems with features such as built in telephone communication and global positioning satellite (GPS) systems. With the introduction of these complex systems, there was a corresponding increase in the complexity of the antennas required. These systems require antennas that can both receive and transmit signals on several frequency bands. The Personal Communication Service (PCS) band and the Advance Mobile Phone Service (AMPS) band are the most common frequency bands used in cellular telephone communication, with the PCS band used primarily for digital transmissions and the AMPS band used primarily for analog transmissions. Global positioning satellite systems operate within a third distinct frequency band known as the GPS band.

Several types of antennas have been used in conjunction with these kinds of communication systems. Patch, dipole and slot antennas are examples of well known types of antennas used in such applications. The predominant mode of reception for these systems is vertical polarization. Single pole and dipole antennas provide polarization in the same direction as the orientation of the antenna, while slot antennas provide polarization perpendicular to the orientation of the antenna. For example, a standard single pole or dipole whip antenna would need to be vertically oriented to achieve the desired vertical polarization. A slot antenna would need to be horizontally oriented to provide the desired vertical polarization. Vertically oriented whip antennas have been used on the rooftop, fenders, and rear windshield of vehicles for mobile telephone reception for several years.

External vertical whip antennas have several disadvantages. First, they are not aesthetically desirable. Also, they are easily susceptible to damage from external forces such as weather, vandalism, and automatic car washes. There exists a desire among vehicle designers to remove the external whip antennas and replace them with on-glass antennas in a manner similar to what had been done previously for radio reception.

On-glass antennas for the complex communication systems used today created a new set of problems. Patch antennas were commonly used because of their small size. However, patch antennas are sensitive to the placement of the antenna relative to the vehicle sheet metal. Placing the antenna close to the roof panel of the vehicle detunes the antenna from the desired center frequency, changes the gain characteristics, and shifts the radiation pattern.

To overcome these problems, it was observed that, by coupling the antenna to the roof panel of the vehicle, the undesirable tuning effects could be minimized. This phenomena is the subject of U.S. Pat. No. 5,959,581 issued to Fusinski, which is incorporated fully herein by reference.

As shown in FIG. 1, coupling of the on-glass antenna unit 101 (mounted to the windshield 107) to the roof panel 105 has been achieved by attaching a thin strip of copper or brass metal 103 to the roof panel 105 at one end and to the antenna unit 101 at the other end. The metal strip 103 was affixed to the roof panel 105 by either soldering or using a pressure sensitive adhesive. This technique provided the benefits associated with coupling the antenna to the roof panel; however it created several drawbacks from a manufacturing standpoint. The installation of the coupling strip proved to be a labor intensive operation. Because the coupling strip 103 was attached to the mounted on-glass antenna unit 101 at one end and the roof panel 105 at the other end, it could not be installed until after the windshield 107 was installed into the vehicle. Thus, the antenna installation required the antenna to be installed in the assembly plant after the windshield installation but prior to the installation of the interior trim components such as the vehicle headliner and moldings. Alternatively, the antenna could be installed as an aftermarket item; however, later installation required the vehicle headliner to be pulled back to contact the conductive strip to the roof panel. This would then require the headliner of the vehicle to be reinstalled.

Another shortcoming with aftermarket installation was that often the adhesive or solder used to install the conductive strip would accidentally come in contact with the headliner. When this would occur, the vehicle would need to have the headliner replaced. This is usually a task that required the vehicle to be returned to the factory where the windshield and headliner were installed.

It is desired to be able to eliminate the coupling strip and the various installation problems associated with the conductive strip, while at the same time maintaining the advantages that are derived from an RF grounding of the antenna unit to the vehicle roof.

It is further desired that the antenna could be mounted to the windshield prior to the installation of the windshield in the vehicle, or that the antenna can be mounted in the vehicle after the windshield glass has been installed without requiring any disassembly of the installed headliner, and in such event, that the antenna unit can be mounted at this stage without using any glues or epoxies that could cause damage to the installed headliner.

SUMMARY OF THE INVENTION

The present invention provides an improved method for creating an RF ground from a glass mounted antenna to the roof panel of an automobile. It provides for a conductive RF path to the roof panel of the vehicle via a grounding path extending on the glass surface from the antenna unit to the roof panel. The grounding path on the vehicle glass is created prior to the installation of the windshield in the vehicle.

In a preferred embodiment, the conductive path is created by applying a conductive fret to the inside of the windshield glass. The windshield is installed into the vehicle using a carbon-loaded epoxy, which is a well known method of installing windshields into automobiles. Because of the properties of the epoxy, an RF contact is created between the conductive fret on the windshield and the roof panel of the vehicle. The antenna is mounted to the vehicle windshield using a high bond adhesive such as a very high bond (VHB) double-sided tape. When the antenna is mounted, a conductive gasket is compressed between a contact area on the antenna unit and a contact area on the conductive fret on the windshield glass, creating a conductive path from the antenna, through the conductive gasket, along the conductive fret, to the top edge of the windshield and to the roof panel via the RF conducting epoxy used to install the windshield. This provides a complete RF ground path from the antenna to the vehicle roof.

DETAILED DESCRIPTION OF THE INVENTION

The present invention is a method of grounding a glass mounted antenna to the frame of the automobile in which the glass is mounted. The method of installation in accordance with the present invention provides for the creation of an RF grounding path from the antenna (or antennas) contained within the antenna unit casing, along the inside surface of the windshield glass via a conductive fret, and to the roof panel via carbon loaded epoxy used in a standard automotive windshield mounting application.

In a preferred embodiment, an antenna unit comprises a small box. The antennas contained within the antenna unit are electrically coupled to a contact area on the casing of the unit. A preferred antenna for use with the present invention is fully described in a related application entitled Multi-Band Antenna Using an Electrically Short Cavity Reflector and assigned to the same assignee as the present invention filed on even date with the present application and incorporated herein by reference. However, it should be understood that the RF grounding method in accordance with the present invention is not limited to a particular antenna and can be used with any antenna that benefits from having an RF ground to the vehicle.

Figure 1:
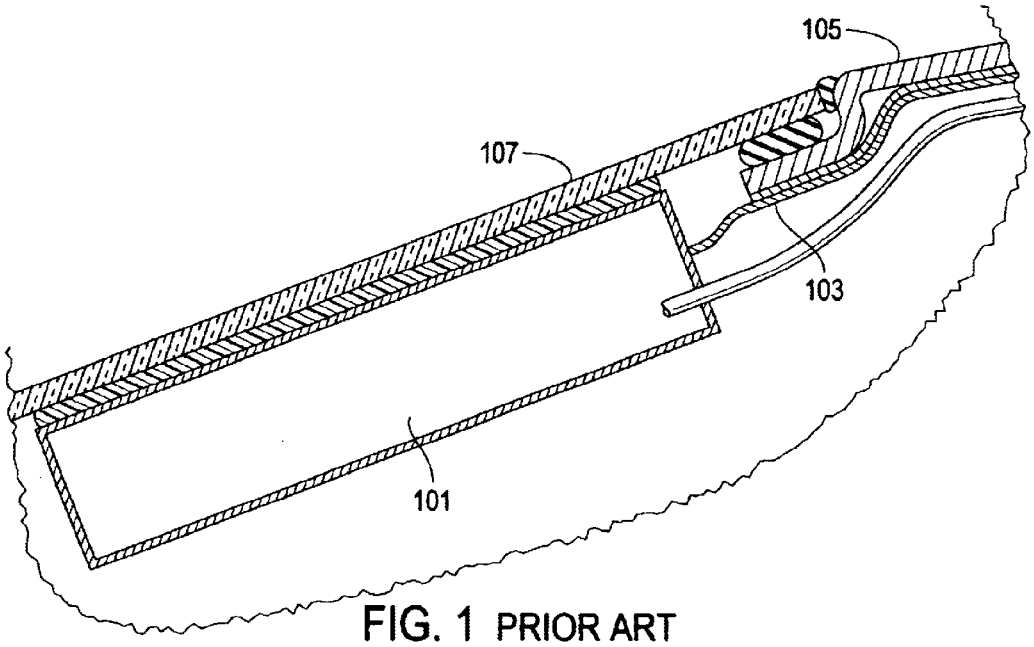
FIG. 1 PRIOR ART
FIG. 1 is a cross-sectional side view of a glass mounted antenna coupled to the roof panel in accordance with the prior art.
Figure 2:
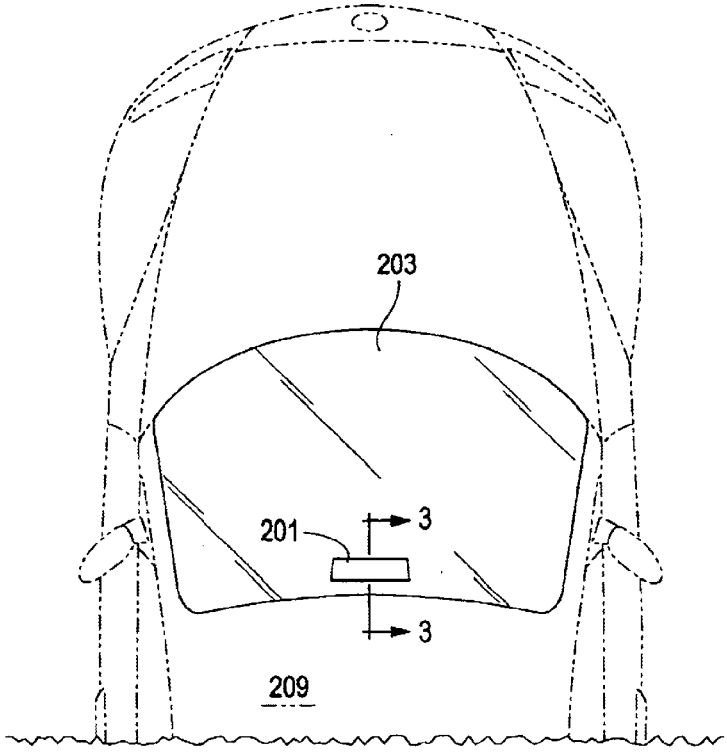
FIG. 2 is a plan view of a vehicle with an on-glass antenna installed in accordance with the present invention showing the location of the antenna relative to the roof panel.

The antenna unit is mounted to a glass surface of the vehicle. Referring to FIG. 2, in the preferred embodiment, the antenna unit 201 is secured to the front windshield 203 of the vehicle just below the roof panel 209 in the vehicle center. Alternate embodiments allow the antenna to be place on the rear window glass (i.e., the backlight), or any of the side window sections that do not retract.

Figure 3:
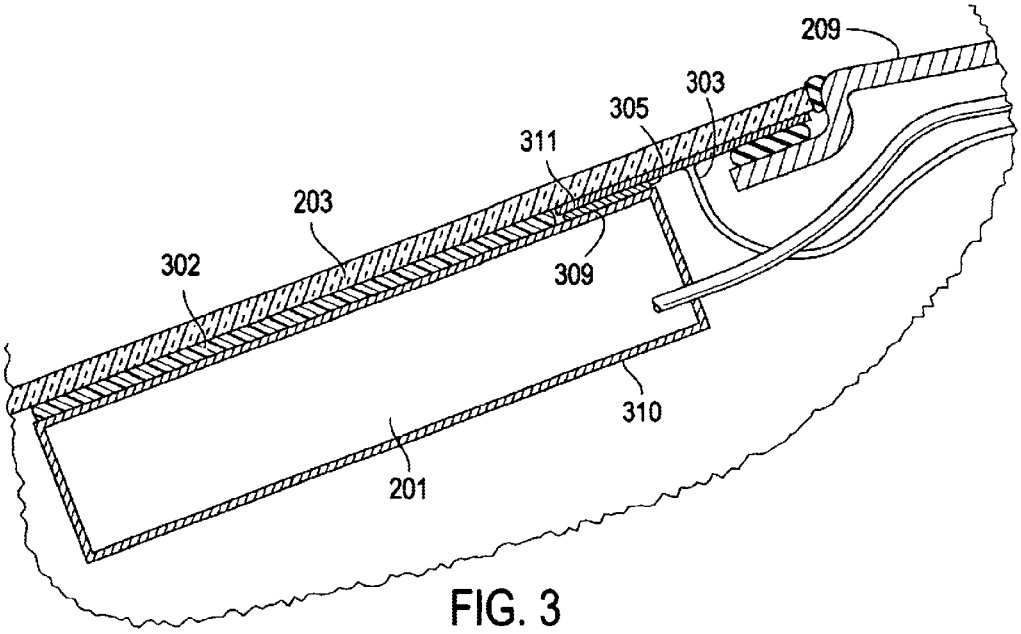
FIG. 3 is a cross-sectional side view of the antenna, windshield, and roof panel showing an antenna grounded in accordance with the present invention.

The antenna unit is mounted to the inside of the windshield glass, as shown in FIG. 3. The antenna 201 is mounted using a strong adhesive. In the preferred embodiment, a double-sided tape 302 such as Very High Bond (VHB) tape from 3M is used to mount the antenna unit to the window. This tape is approximately 0.040" thick and adheres extremely well to both glass and plastic materials. As a result, a permanent bond can be made between the windshield glass and the plastic casing of the antenna unit.

The antenna unit can contain a plurality of antennas. Any antennas that achieve an improved performance as a result of being RF grounded to the vehicle roof panel are electrically coupled within the antenna unit 201 to a contacting area 309 on the antenna unit casing 310. It is through this area that a conductive RF path to ground will be established. Upon mounting, an electrical contact is created between the antenna unit 201 and a conductive path 303 on the windshield 209. The electrical contact between the casing of the antenna unit and the conductive path 303 is achieved by compressing a conductive gasket 305 between the contact area 309 on the antenna unit casing and a contact area 311 on the conductive path 303 existing on the windshield 209.

The conductive gasket 305 in the preferred embodiment comprises a silicon elastomer loaded with nickel coated graphite particles; however, alternative embodiments could use various conductive gasket material such as oriented wires in silicone, woven Sn/Cu/Fe gaskets, or elastomers loaded with other conductive materials, all of which are well known in the art. The durometer and thickness of the conductive gasket 305 is selected such that sufficient compression is achieved when the antenna unit is mounted using the VHB 0.040" thick tape. When the antenna unit is mounted to the windshield, the gasket material is compressed between the contacting area 309 on the antenna unit and the contact area 311 on the windshield, as shown in FIG. 3. The conductive gasket is compressed to a 0.040" thickness, assuring electrical RF contact between the contacting area 309 of the antenna unit and contacting area 311 on the conductive path on the windshield. In a preferred embodiment, a CHO-SEAL 6309 gasket manufactured by Chomerics (Woburn, Mass.) is used.

The conductive path 303 on the windshield glass is created by applying a conductive fret to the inside of the windshield in a small area at the top center of the windshield glass. In the preferred embodiment, the conductive fret comprises a grid created by applying a conductive epoxy paint to the windshield, preferably using a silk-screen or spray technique. Conductive epoxy paints are paints loaded with metal particles to form a conductive surface, and are well known in the art. Conductive epoxies can be loaded with various metal particles such as silver, copper, or nickel. In the preferred embodiment, a silver loaded conductive epoxy paint is used. When selecting the material for the conductive fret, possible galvanic reactions between the fret and the conductive gasket material that will be used to create a contact between the fret and the antenna unit must be considered. Certain dissimilar materials will galvanically react in the atmosphere, causing oxidation or corrosion that will reduce or eliminate the electrical contact. Thus, in the preferred embodiment, the silver epoxy used for the fret work will exhibit a minimum galvanic reaction with the conductive gasket used.

Figure 4:
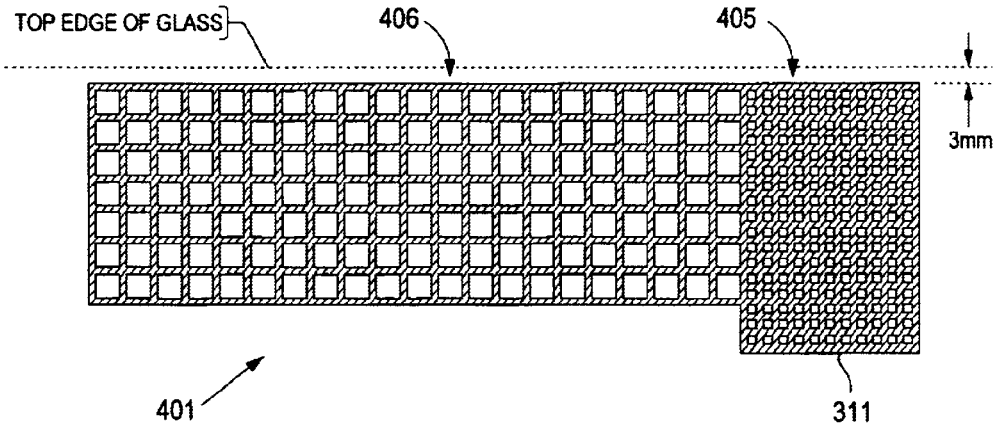
FIG. 4 is a plan view of the conductive fret that is applied to the windshield in accordance with the present invention.

The grid pattern of the conductive fret 401 is shown in detail in FIG. 4. The conductive gasket contacts the fret 401 in the fret contact area 311. The section of the fret 401 located on the section of the windshield directly above the contact area 311 comprises a compressed grid 405. The section of the fret located between the antenna and the roof panel in the areas other than directly above the contact area comprises a less concentrated grid pattern 406. This area is primarily to provide ground stability for the antenna unit. By using a less compact grid, the amount of silver epoxy used is reduced; thus, cost is reduced.

The conductive fret extends to close to the top edge of the windshield. In the preferred embodiment, the fret extends to approximately 3 millimeters from the top edge. In order to provide the necessary RF grounding path, the fret must extend into the area that will be covered by the adhesive used to mount the windshield to the roof panel. In the preferred embodiment, the fret is applied to the windshield using a silk screen process or a spray process prior to the windshield installation into the vehicle. These processes can be sufficiently controlled to assure accurate positioning of the fret 401 upon the windshield.

After the fret has been applied to the windshield, the windshield is installed into the vehicle using standard windshield installation techniques. Common windshield installation includes affixing the windshield glass by bonding the glass to the vehicle using a strong black windshield adhesive such as U-400HV manufactured by EssexARG (Dayton, Ohio). Standard windshield adhesives are urethane based. They are black in color, which improves UV stability and aesthetics. To give the adhesive the black color, the urethane adhesives are heavily loaded with carbon. As a result of the carbon loading, the properties of the adhesives used in the automotive industry to mount windshields are such that the adhesive will provide an electrically grounding path in the RF band (at 200 MHz–400 MHz) between the fret located on the windshield and the roof panel to complete the RF grounding path from the antenna to the roof panel. Because of the semi-insulating properties of the adhesive along with the paint that exists on the vehicle roof panel, the conductive path will not act as a DC ground; however, sufficient capacitive or parasitic coupling will exist to allow it to act as a ground in the RF spectrum critical to the performance of the antenna unit.

The installation method in accordance with the present invention provides several advantages over the techniques used in the prior art. The antenna mounting no longer requires the removal of the headliner, regardless of whether the antenna is mounted at the manufacturing facility or as a part of an aftermarket windshield replacement. In the initial factory installation phase, the present invention makes it possible for the antenna installation process to be conducted by the windshield provider. Thus, no changes need to be made to the production line where the windshields are installed to accommodate an additional antenna installation process. In the aftermarket phase, the present invention removes the problem of damaging the vehicle headliner during the antenna installation process because there is no longer a need to remove the headliner to install the antenna. As a result, the present invention provides for a more efficient, and thus less expensive, manner of achieving the RF ground from the antenna to the roof panel which is required to assure optimum antenna performance.

It should be understood that the foregoing is illustrative and not limiting and that obvious modifications may be made by those skilled in the art without departing from the spirit of the invention. Accordingly, the specification is intended to cover such alternatives, modifications, and equivalence as may be included within the spirit and scope of the invention as defined in the following claims.

I claim:

1. A method for RF grounding a glass-mounted antenna to a metal frame of a vehicle, said method comprising the steps of:

providing an RF grounding path on a piece of glass from an antenna mounting location on said piece of glass to an edge of said piece of glass;

installing said piece of glass on a metal frame of a vehicle using an adhesive between said edge and said metal frame, said RF grounding path and said metal frame being electrically coupled through said adhesive; and electrically coupling said antenna to said RF grounding path via a conductive gasket.

2. A method as set forth in claim 1, wherein said adhesive is a carbon-loaded urethane.

3. A method as set forth in claim 2, wherein said adhesive is Essex U-400HV.

4. A method as set forth in claim 1, wherein said step of electrically coupling said antenna to said RF grounding path comprises:

mounting said antenna to said piece of glass at said antenna mounting location prior to installing said piece of glass on said metal frame.

5. A method as set forth in claim 1, wherein said piece of glass comprises a front windshield.

6. A method as set forth in claim 1, wherein said RF grounding path comprises a conductive epoxy fret applied to said glass.

7. A method as set forth in claim 6, wherein said conductive epoxy is silver loaded.

8. A method as set forth in claim 1, wherein said antenna comprises at least a GPS patch antenna.

9. A method as set forth in claim 1, wherein said step of electrically coupling said antenna to said RF grounding path comprises:

mounting said antenna to said piece of glass at said antenna mounting location after said piece of glass is installed on said vehicle.

10. A system for RF grounding a glass-mounted antenna unit to a metal frame of a vehicle, said system comprising:

a piece of glass having an antenna mounting location and an edge;

an RF grounding path on said piece of glass, said RF grounding path extending between said antenna mounting location and said edge such that, when said piece of glass is installed on a metal frame of a vehicle with adhesive between said edge and said metal frame, said RF grounding path and said metal frame are electrically coupled across said adhesive an antenna unit having at least one antenna within a casing, said casing having a contact area electrically coupled to said at least one antenna, said contact area being electrically coupled to said RF grounding path at said antenna mounting location on said piece of glass via a conductive gasket.

11. A system as set forth in claim 10, wherein said electrical coupling between said RF grounding path and said metal frame is achieved via capacitive coupling.

12. A system as set forth in claim 10, wherein said glass comprises a front windshield of a vehicle.

13. A system as set forth in claim 10, wherein said conductive gasket comprises a conductively loaded silicon.

14. A system as set forth in claim 10, wherein said at least one antenna comprises a patch antenna.

15. A system as set forth in claim 10, wherein said RF grounding path residing on said piece of glass comprises silver loaded epoxy.

16. A system as set forth in claim 10, wherein said adhesive comprises a carbon loaded urethane.

17. A system as set forth in claim 16, wherein said adhesive comprises Essex U-400HV.

* * * * *